US005890603A

United States Patent [19]

Arguin et al.

[11] Patent Number: 5,890,603

[45] Date of Patent: Apr. 6, 1999

[54] METHOD AND DEVICE FOR ATTACHING OBJECTS TO APPLIANCES

[76] Inventors: Donald G. Arguin, HCR 33, Box 221, Keene, N.H. 03431; Frederick A. Alibozek, 35 Birch Rd., Peterborough, N.H. 03458

[21] Appl. No.: 832,064

[22] Filed: Apr. 2, 1997

Related U.S. Application Data

[63] Continuation-in-part of Ser. No. 625,593, Apr. 3, 1996, Pat. No. 5,678,792.

[51] Int. Cl.[6] ..... A47F 5/00

[52] U.S. Cl. ..... 211/45; 211/89; 248/918; 248/442.2; 312/7.2

[58] Field of Search ..... 211/45, 89; 248/918, 248/309.1, 442.2, 451; 312/7.2, 183

[56] References Cited

U.S. PATENT DOCUMENTS

| | | | |
|---|---|---|---|
| 2,704,302 | 3/1955 | Budd | 248/316.7 X |
| 4,089,116 | 5/1978 | Bearinger | 211/45 X |
| 4,475,705 | 10/1984 | Henneberg et al. | 248/442.2 X |
| 5,301,915 | 4/1994 | Bahniuk et al. | 248/918 X |
| 5,363,150 | 11/1994 | Kojima | 312/7.2 X |
| 5,575,545 | 11/1996 | Wang | 312/7.2 |
| 5,678,792 | 10/1997 | Arguin et al. | 248/442.2 X |
| 5,683,070 | 11/1997 | Seed | 248/918 X |
| 5,743,414 | 4/1998 | Baudino | 211/89.01 X |
| 5,769,374 | 6/1998 | Martin et al. | 348/918 X |

*Primary Examiner*—Robert W. Gibson, Jr.
*Attorney, Agent, or Firm*—George W. Dishong

[57] ABSTRACT

The present invention is directed to an inexpensive display device and a method of attaching articles such as pictures, notes and the like to appliances. The invention is substantially a flexible, length-wise deformable band which is extended around the perimeter of the outer surface covering of an appliance. The band may be secured in place by the deformable material of the band creating frictionous contact with the outer surface covering of the appliance. The articles are attached to the display device by inserting them into at least one channel cut length-wise into the band. A plurality of short channels may also be cut at a selected predetermined angle to the length-wise center-line of the band. The preferred angle being between about 30 and 90 degrees. The device may be configured as a continuous stretchable band or may be made having ends which are adjustably attachable each to the other. The articles are held in place in the channel by the material of the device creating frictionous contact with the articles. In another embodiment of this invention, a length-wise deformable band having no channel is installed around the perimeter of the outer surface covering of an appliance, in mating contact with at least one supporting portion formed in the outer surface covering of an appliance. The at least one supporting portion may be a raised appliance channel created by at least one raised extension or a recessed appliance channel created by a recessed channel formed into the outer surface covering of the appliance. There may also be combinations of appliance channels of the raised extension appliance channel and recessed appliance channel type. An article to be displayed is then inserted between the length-wise deformable band and the supporting portion and is held in place by the mating contact between the length-wise deformable band and the supporting portion. In still another embodiment, at least one clip may be attached to a substantially flat length-wise deformable band installed around the perimeter of an appliance. Articles are displayed in the clip by inserting an edge of the object into the clip and then sliding the article into the clip.

28 Claims, 7 Drawing Sheets

METHOD AND DEVICE FOR ATTACHING OBJECTS TO APPLIANCES

This application is a Continuation in Part of U.S. patent application Ser. No. 08/625,593, filed Apr. 03, 1996, now U.S. Pat. No. 5,678,792.

BACKGROUND OF THE INVENTION

1. Field of the Invention

This invention most generally relates to a method of and a device or apparatus for use in attaching articles to the perimeter of an appliance.

More particularly this invention relates to an inexpensive, unobtrusive method of and a device or apparatus for use as a means for attaching small articles such as notes or pictures around the perimeter of an appliance such as, for example, a computer display monitor, television monitor a microwave or the like. The invention allows the user to attach the articles without having to clip, staple, or tape or otherwise damagingly secure or attach the articles to either the appliance or to a large, cumbersome device attached to the appliance, which device when attached to the appliance may cause damage to the appliance.

Most particularly this invention relates to a method and device for attaching articles such as, but not limited to, photographs, around the perimeter of an appliance such as a computer display monitor, television monitor, a microwave or the like wherein the appliance has incorporated therein a method and device for displaying articles. The device may be disposed on the appliance by attachment of the device to the appliance or by forming the device on the appliance at the time of manufacture of the appliance.

Note and memo boards have long been used in a wide variety of ways around homes and offices. Most memo boards are fairly large and incorporate a variety of surfaces such that a user may either write on the board or tape or tack notes to the board.

With the development of computers, note boards have been adapted to fit on or around computer monitors to attach important instructions, reminders or other articles desired by the user. Note boards have also been adapted to fit on or around other appliances such as microwaves or telephones. However, due to the need for a relativelylarge, flat surface, note boards are rather cumbersome to attach to relatively small appliances such as those listed above. Thus, there were developed other ways of attaching articles to appliances such as the use of small POST-IT® brand of stick-on notes which are convenient, but tend to lose their adhesive properties and fall off of the appliance to which they are attached.

There have also been large devices which clamp around, for example a computer monitor, and which hold carriages or panels for whole sheets of paper in order that the user may copy material from the paper and enter it into the computer. These devices are convenient for large sheets of paper, but not for small reminders or pictures. In addition most of the current devices are cumbersome, and not easily installed and removed.

To date there has not been developed any small, unobtrusive, inexpensive, easily installed device to hold notes, reminders, photographs or other articles without having to write on the device or stick the note to the device with either a tack, or some adhesive such as tape. The method and device of the present invention is simpler and less permanent than previous devices, including those devices indicating that they are removable. Adhesive tape, screws, or even VELCRO® brand of hook and loop fastener with tape, can be difficult to align and install as well as invariably leaving permanent installation marks. For those devices requiring adhesive, fresh adhesive is needed with reinstallation. Thus, it would be desirable to be able to include a device for holding articles which is either incorporated into the appliance at the time of manufacture or simply attachable to the appliance to eliminate the need for additional, clumsy, after-market attachments. The present invention requires no complicated installation.

2. Description of the Prior Art

Eight patents were reviewed as part of the prior art. The seven United States Patents reviewed were U.S. Pat. Nos.; 4,869,565 to Bachman, 5,104,087 to Wentzloff et al., 3,817,486 to Liljequist, 5,292,099 to Isham et al, 5,301,915 to Bahniuket al., 4,456,315 to Markleyet al., and 5,398,905 to Hinson and one British Pat. No. 736,328 to McGloin. None of the prior art addresses the problem of attaching articles to appliances by providing a method and device for holding articles which may be a built-in feature of an appliance when the appliance is manufactured.

The U.S. Pat. No. 4,869,565 discloses a display apparatus which is affixed to the sides and top of a computer monitor. The specification and claims are directed specifically to computer monitors only. The device consists of what they call "longitudinal channel members" and "display members". The channel members are material adhesively bonded to the two vertical sides of the monitor and to the top. They contain channels into which are inserted panels which are the display members on which notes are attached. The channel members are three separate, non-contiguous pieces which must be aligned and the channels are designed to hold large L-shaped display members that extend up the sides of the monitor and across the top. Any notes are attached to the display members, not inserted into the channels themselves. The device is expandable to fit different sized monitors, but the adjustment is accomplished by sliding the display panels in the channels, not by adjusting the channel containing members. Moving the channel containing members to another appliance or removal and reinstallation to the same appliance requires fresh tape and realignment of the members.

The British patent No. 736,328 discloses "supports for show cards". The device is a block of resilient, manually deformable material with a slit in which an edge of a "show card" or other similar material is held by compression between the opposite faces of the slit The holding device is quite different from the instant invention. The device of the British patent is not designed to fit around an appliance nor is it made to be attached around the perimeter of an object by lengthwise deformation of acontinuous device. It is designed to be stuck to a store window or shelf, or in another design, to be attached to a rod such as a flag pole or bicycle frame.

U.S. Pat. No. 5,104,087 discloses a memo or note board constructed to be associated with an "information display device". The board is substantially U-shaped and fits around a monitor for example. The device is held in place by strips of VELCRO® brand of hook and loop fastener with tape by a strip on the monitor, and a matching strip on the device, and adjusted in place with a series of brackets, making installation or relocation seemingly cumbersome and time consuming. The board can be of a material suitable for sticking tacks into to hold notes, or may be made of a material which can be written on and erased, or can be part of two different materials for two different purposes. There are no channels for insertion of paper, and the device is not one piece, although it is directed to be used with appliances other than computer monitors.

U.S. Pat. No. 3,817,486 is directed to a holder f or notes, messages, and business cards, etc. The invention is a device designed to hold paper clips or other standard form wire holders. The device consists of a base which can be attached to a telephone, wall or dashboard of a vehicle, and channels to hold the wire paper holders in place. There are channels or slots in the device to receive the wire paper holder, but the paper is not held directly by the device. This device is also mounted with the use of adhesive tape.

U.S. Pat. No. 5,292,099 discloses a display mounted document holder designed to clamp to a display monitor. The device is substantially U-shaped and fits clamped over the top and down the sides of, for example, a computer monitor. Attached to the vertical sides of the U-shaped piece are a series of "slideways" designed to receive arms attached to document platens or holders. Thus, various sized and shaped holders can be attached to the U-shaped piece by inserting arms attached to the document holders into the slideways. The arms designed to hold the platens may have hinges such that the platen or holder may be swung out of the way, and flush with the side of the monitor. The base U-shaped piece can be adjusted to fit over differently sized display monitors. However the device is not one piece and the device itself does not hold the documents. Also, the device is rather large, and designed to hold materials such as full sheets of paper as opposed to a multitude of smaller sheets.

The U.S. Pat. No. 5,301,915 describes a note holder board. The board is designed to have notes clipped or stuck to it. The board is held in place on either the top or side of a display monitor by a "support means" which is attached to the monitor with either VELCRO® brand of hook and loop fastener or with double-sided tape. The concept of holding smaller notes with this invention is disclosed. The notes are stuck to a large board, and not inserted into channels. In order for the notes to remain on this device they must be clipped or stuck by some adhesive.

U.S. Pat. No. 4,456,315 is directed to a device for protecting a computer or business machine monitor from damage due to use and abuse. A flexible, resilient band extends around the perimeter of the appliance, however there is no provision or intention for this device to be able to hold anything. It is simply designed to protect the monitor from damage from being bumped.

Finally, U.S. Pat. No. 5,398,905 describes a die-cut display board for a computerized display screen. The device is designed to fit around the face of a computer monitor such that it is flush with the screen. The device is made of one piece. The middle region, where the screen would be is scored such that the middle may be pushed apart creating tabs to be folded in towards the back side of the device to lie on the top and sides of the monitor to form the opening for the screen. The tabs are then fastened to the monitor to secure the device to the monitor. The device can also have a holder attached for holding writing instruments, and can be shaped in any number of novelty designs such as a football or baseball. The device is meant to hold small notes or similar items, however, as with the U.S. Pat. No. 5,301,915 to Bahniuk et al, the materials must be clamped or stuck to the board with adhesive.

SUMMARY OF THE INVENTION

The present invention provides a display device and method for securely but removably attaching articles such as for example notes and photographs to appliances. The present invention is simpler and less permanently attached to the appliance than previous devices, including those devices indicating that they are removable. A preferred embodiment of the present invention is a band comprising a continuous piece of resilient, flexible, lengthwise-deformable material sized in various sizes to fit around differently sized appliances, along the length of which may run one or more channels or slots. Alternatively, a plurality of slots may be oriented cross-wise to the band at any predetermined angle the preferred being from about 30° to about 90°. The material of which the display device of the present invention is made may be any lengthwise deformable material such as, but not limited to; latex, silicone, urethane or other elastomers or synthetic materials which preferably have about 500% to about 700% elasticity and which preferably do not have any type of internal cords or fibers. The desired articles to be displayed are inserted into the channel at whatever location the user desires. The resilient, flexible nature of the device is such that the material of the device forming the channel securely holds in place the articles inserted into the channel. The dimensions of the display device vary so as to fit different appliances and permit the attachment of different articles thereto. Once installed on an appliance the display device will not slide or rotate out of position unless sufficient force is used to deform and remove the device from the appliance The invention could also be made from a band of resilient, flexible material that is not continuous, but has an opening at one point. There would be two ends which would be adjustably attachable creating thereby a continuous device when attached around the periphery of an appliance. For example, each end might have attached matching portions of VELCRO® brand of hook and loop fastener. The embodiment of the device having two adjustably connectable ends may also be lengthwise deformable which deformation amount will effect the level of frictionous contact to the appliance, thus securing the device in place on the appliance. The device could be size adjusted more easily to fit the appliance on which the device were being installed if the device were able to be opened. The device is easily removable and transferable to other appliances in very little time.

The device has a cross section such that articles, when attached to the device, are facing the viewer or user of the appliance. However, the display device of the present invention could also be mounted around the perimeter of a table or vertically along, for example, a wall, such that the desired articles may be displayed in a variety of orientations. The device could also be mounted such that it extends over the base of articles displayed on an appliance in order to hold the articles in place on the surface of the appliance.

The surface of the device which contacts the appliance, when the device is placed on the appliance, may be configured to provide substantial contact area and be surfaced to provide frictionous contact.

The base material into which the channel or channels are cut or otherwise formed, may also have different configurations, such as feet, to raise the main display part of the device off of the surface of the appliance to which it is attached, to enhance the securing of the device to the appliance, or to better position and secure the displayed articles for viewing depending on the angle of the surface of the appliance to which the device is attached. The base of the device may also contain a depression which aids the hand of the user such that the channel may be opened more easily to facilitate insertion of the desired articles.

In other embodiments, the size and shape of the channel may be such that different articles may be used in the device, from pieces of paper or photographs to standard production picture frames. There may also be multiple channels for insertion of a greater number and variety of articles.

It would be advantageous to provide a method and display device which has the following objects and advantages: being easy to attach and remove from the appliance; easily and inexpensively manufactured; very unobtrusive and almost unnoticeable if no articles are attached to the device; inexpensive method and display device for attaching notes, photographs and other objects or articles of personal value to appliances, which articles are easily installed and removed from an appliance; easily adjusted to fit differently sized appliances; may provide a continuous display device to which articles are attached directly without adhesives, tacks or special panels, arms or other tooling; easily accessible and convenient to the user, for attachment and removal of articles; and does not interfere with the use of the appliance It is another object of the invention to provide a display device having all of the above advantages but which may be opened or disconnectable at one point in order to facilitate installation and removal of the device from appliances.

Yet another object of the invention is to provide a display device for attaching articles to appliances comprising a flexible, lengthwise deformable band having a base portion; and at least one length-wise running channel cut in the lengthwise deformable band. Alternatively, a plurality of width-wise running channels may be cut in the lengthwise deformable band at an angle to a length-wise running centerline, the angled channels angled between at a preselected angle but preferably between about 30° and about 90° to the length-wise running centerline.

The present invention also solves the problem of how to attach articles, such as photographs, to appliances in a convenient, unobtrusive manner. The invention may include a continuous one piece, or two-ended one piece closable, flexible length-wise deformable band which is installed on an appliance in a manner which mates the band with at least one complimentary, supporting portion on the appliance. The supporting portion may be built-in or attached later, i.e., after manufacture. The at least one supporting portion, whether built-in or later attached, may take the form of a channel or groove in the covering of the appliance or may take the form of a raised extension into which may be placed the deformable band. Further, there may be a plurality of supporting portions whether they be channels or raised extensions or combinations of such supporting portions. The deformable band in association with either of the forms of supporting portion creates the device which will hold articles when the articles are inserting between the band and the supporting portion.

A further object of the invention to provide a holding device which allows the length-wise deformable band and the complimentary supporting portions of an appliance to be uncomplicated designs and yet still provide a convenient, easily workable means for displaying articles.

Yet another object of the invention is to allow manufacturers of appliances to include on the appliance a low-cost "built-in" means for displaying articles.

Still another object of the invention is to facilitate the entire perimeter of an appliance to be used for displaying articles.

Yet still another object of the invention is to provide a "built-in" means for displaying articles requiring minimal modification to the specific existing manufacturing processes.

A primary object of the invention is to provide a display device for attaching articles to an appliance and displaying the articles on the appliance comprising: an outer surface covering of the appliance; at least one supporting portion disposed on the outer surface covering of the appliance; and a flexible, length-wise deformable band installed in mating contact with the at least one supporting portion such that an article to be displayed is inserted in mating contact between the length-wise deformable band and the supporting portion. The outer surface covering of the appliance may have a front section and a back section. The front section and back section when assembled create thereby an appliance channel having at least one substantially flat wall substantially perpendicularly directed from the outer surface covering of the appliance located perimetrically to the front-facing portion of the appliance.

Another primary object of the invention is to provide the display device as above wherein the at least one supporting portion disposed on the outer surface covering of the appliance is the appliance channel; and the flexible, length-wise deformable band is installed within the appliance channel such that an article to be displayed is inserted in mating contact between the length-wise deformable band and one of the at least one substantially flat wall of the appliance channel. The length-wise deformable band is preferably a one-piece, continuous band but may also have ends which are attachable to each other or attachable to the appliance.

Yet another primary object of the invention is to provide the display device as above described but wherein each of the at least one supporting portion further comprises a raised extension having at least one substantially flat surface substantially perpendicularly directed from the outer surface covering of the appliance wherein the at least one substantially flat surface is in mating contact with the length-wise deformable band. The at least one supporting portion is disposed either on the front section or the back section of the outer surface covering of the appliance. There may also be a cooperating raised extension having at least one substantially flat surface substantially perpendicularly directed from the outer surface covering. The cooperating raised extension flat surface and the raised extension flat surface oppose each other creating a raised extension appliance channel therebetween into which the length-wise deformable band is or may be installed. The raised extension may be disposed on the front section of the outer surface covering of the appliance and the cooperating raised extension disposed on the back section thereby forming the raised extension appliance channel at a location where the front section back section of the outer surface covering of the appliance are joined.

Yet still another primary object of the invention is to provide the display device as above but wherein the at least one supporting portion comprises a recessed channel disposed on the outer surface covering. The recessed channel has at least one substantially flat surface substantially perpendicularly directed from the outer surface covering creating thereby a recessed appliance channel into which the length-wise deformable band is or may be installed. The recessed channel may be in either the front or the rear section of the covering. The at least one supporting portion may further comprise a cooperating recessed channel having at least one substantially flat surface substantially perpendicularly directed from the outer surface covering and wherein the cooperating recessed channel flat surface and the recessed channel flat surface oppose each other creating a recessed appliance channel therebetween into which the length-wise deformable band is installed. The recessed channel may be located on either the front section or the back section of the outer surface covering.

The length-wise deformable band typically has a circular cross-section but may have cross sections such as elliptical, D-shaped, non-circular or other cross sections which will accomplish the objectives of holding article for display.

Yet still another primary object of the invention is to provide a method for displaying articles on an appliance having an outer surface covering thereof comprising the steps of: forming at least one supporting portion in the outer surface covering; installing in mating contact with the at least one supporting portion, a flexible length-wise deformable band; and inserting articles in mating contact between the at least one supporting portion and the length-wise deformable band, thereby displaying the articles.

A still further object is to provide yet another method for attaching at least one object to an appliance comprising installing a flexible, length-wise deformable band around the perimeter of the appliance, attaching at least one clip to the band, and inserting an edge of at least one article into the clip whereby the object is secured in the clip.

Another object is to provide a display device for attaching articles or objects to an appliance and displaying the articles on the appliance comprising an outer surface covering of the appliance defining the perimeter of the appliance, a flexible, length-wise deformable band installed around the perimeter of the appliance in mating contact with the outer surface covering of the appliance, and a clip secured in mating contact between the outer surface covering of the appliance and the length-wise deformable band.

A further object still is to provide the display device in which the clip comprises a lower substantially flat portion, and a gripping prong and guiding prong. The gripping and guiding prongs extend upwards from the lower substantially flat portion. The gripping prong and the guiding prong substantially oppose each other and are spread apart when an article is inserted in mating frictionous contact between the gripping prong and the guiding prong whereby the article is secured in the clip by the mating frictionous contact between the prongs.

These and other objects will become apparent to one of ordinary skill in the art to which this invention pertains, upon reviewing the following detailed description and claims describing and defining this invention.

DESCRIPTION OF THE PREFERRED EMBODIMENTS

The present invention is directed to an inexpensive display device and a method of attaching objects or articles such as pictures, notes and the like to appliances. The invention is substantially a flexible, lengthwise deformable band which is extended around the perimeter of an appliance. The band is secured in place by the deformable material creating frictionous contact with the appliance. The articles are attached to the display device by inserting them into at least one channel cut length-wise into the band. A plurality of short channels may also be cut or formed substantially orthogonal to the length-wise center-line of the band. The device may be as a continuous stretchable band or may be made having ends which are adjustably attachable each to the other. The articles are held in place in the channel by the material of the device creating frictionous contact with the objects.

Figure 1:
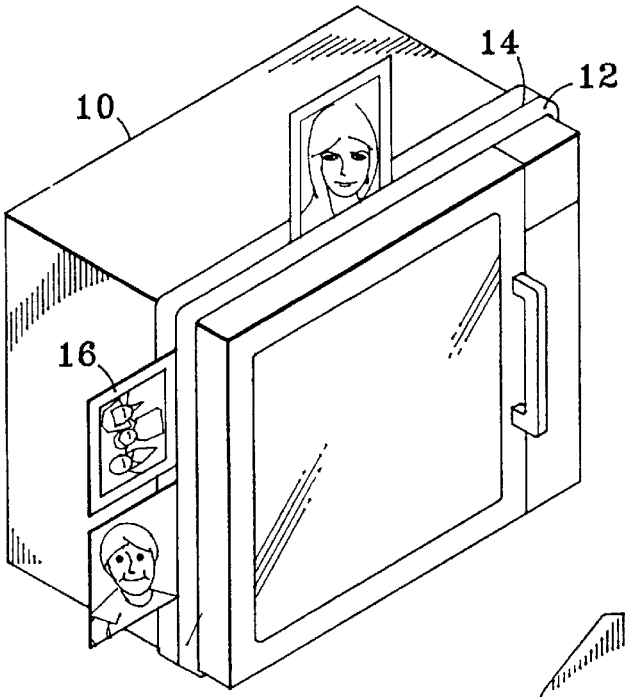
FIG. 1 is a perspective view of the display device showing the invention installed on an appliance with articles attached to the appliance.

Referring now in detail to the drawings, wherein similar reference numerals denote similar elements throughout the drawings, the present invention, as shown in FIG. 1. provides the display device 12 installed around the perimeter of an appliance 5. Articles such as photographs 16 are shown inserted into a channel 14 in display device 12. Display device 12 may be manufactured by extruding, molding, casting, general machining or various other forming methods. Display device 12 may also be manufactured in separate pieces such as a base portion and a channeled portion which separate pieces may be subsequently removably or more permanently attached each to the other prior to or subsequent to making attachment of the device to an appliance such as a personal computer (PC) monitor. If the device is made from multiple pieces the pieces may be removably attached or more permanently attached such as by gluing or bonding each piece appropriately positioned next to or on top of each other.

Figure 2D:
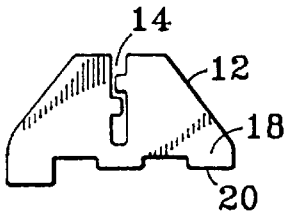
FIGS. 2A through 2J each show various configurations of the channel and the base portion of the display device.
Figure 2E:
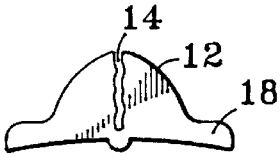
Figure 2F:
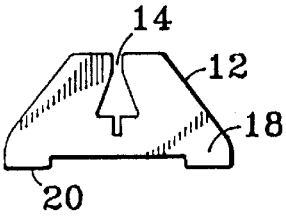
Figure 2G:
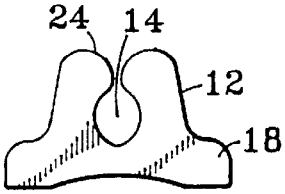
Figure 2:
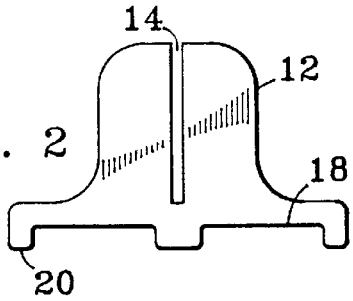
Figure 2H:
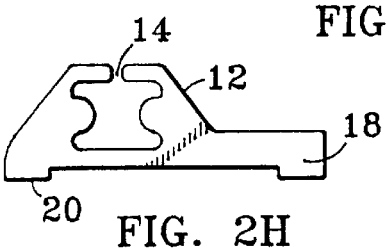
Figure 2A:
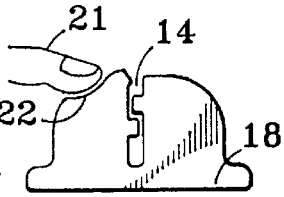
Figure 2B:
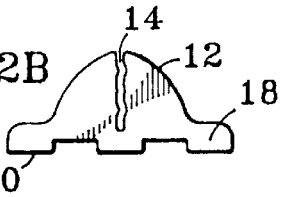
Figure 2I:
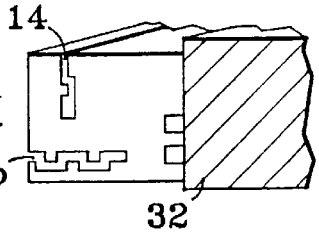
Figure 2C:
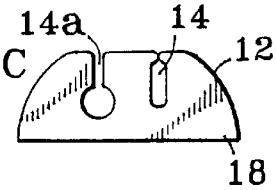
Figure 2J:
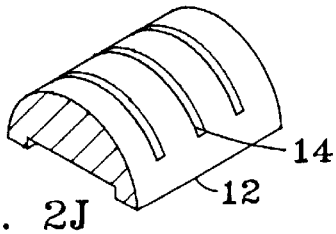

As shown in FIGS. 2–2J, display device 12 may have a base portion 18 which may be flat or be formed with feet 20. Channel 14 may be formed in various sizes and shapes to accommodate various objects. Channel 14 may extend or be cut to form a continuous channel throughout the length of display device 12 or may be formed to several non-continuous channels.

FIG. 2A shows an indentation feature 22 such that a finger 21 may be placed into indentation 22 to facilitate opening of channel 14 for insertion of an article. FIG. 2B shows feet 20 formed in base portion 18 to allow for better positioning of display device 12 on irregular or non-flat surfaces. FIG. 2C depicts multiple channels 14 and 14*a* of various sizes and depths to add to the range and number of articles able to be held by display device 12.

FIG. 2D illustrates how feet 20 may be of varying height to apply additional frictionous contact to an appliance, to conform to appliances with angled surfaces, or to orient the displayed article at a forward or backward angle.

FIG. 2E illustrates how base portion 18 may be formed to add additional pressure to the article being held.

FIG. 2F shows that channel 14 may be formed with changing width to accommodate articles of various thickness, by varying the depth to which an article is inserted into channel 14.

FIG. 2G illustrates a tapered entrance portion 24 of channel 14 formed to facilitate entrance of articles into channel 14.

FIG. 2H illustrates that base portion 18 may be asymmetrical in order to allow articles to be presented in a forward or rearward manner while still providing frictionous contact distributed over a wider area of an appliance.

FIG. 2I shows an embodiment of the invention wherein the display device 12 is mounted to a horizontally planar surface. This figure also demonstrates multiple channels 14 and 14*b* oriented perpendicular (but could otherwise be at various other combinations of angles) to each other such that articles may be inserted and displayed in a variety of orientations simultaneously. For example, display device 12 could be placed around a table top 32 where playing cards could be inserted into channels 14 or 14*b*.

FIG. 2J illustrates an embodiment of the invention wherein channels 14 are non-continuous and do not run lengthwise throughout display device 12.

Figure 3:
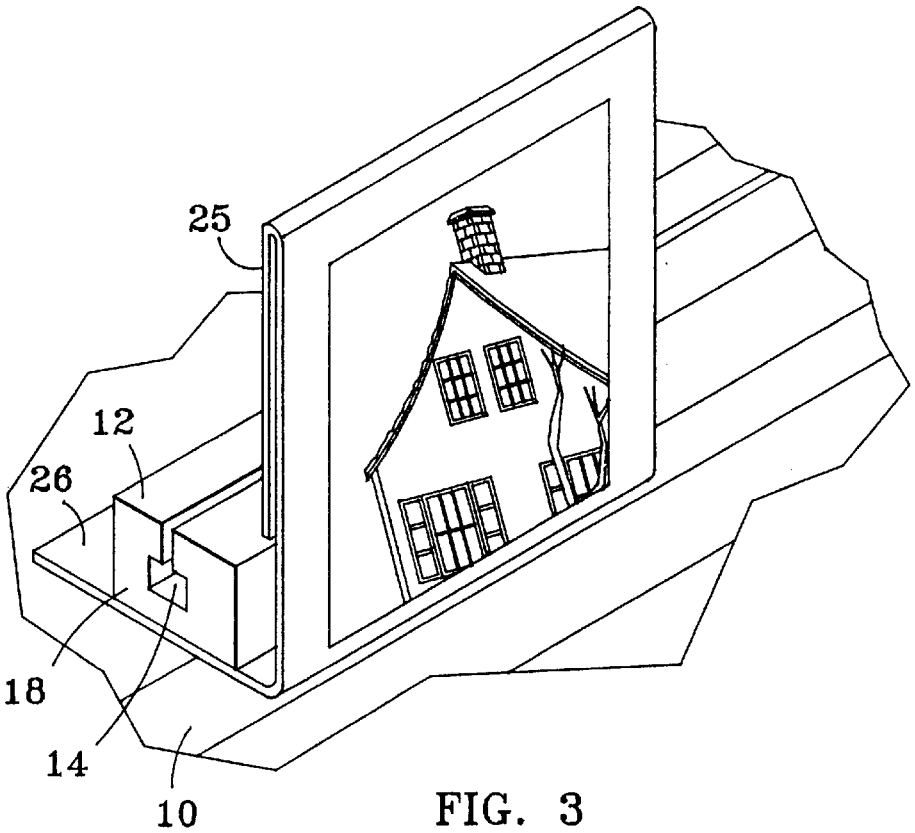
FIG. 3. is a perspective view of the display device showing how the frictionous contact of the display device with the appliance is used to secure articles to appliances in a manner other than by inserting the articles into the channel in the display device.

In FIG. 3 it is shown that display device 12 may be used to secure articles such as an L-shaped picture frame 25 with base 26, to appliances, by way of the display device frictionous contact with the surface of appliance 10.

Figure 4:
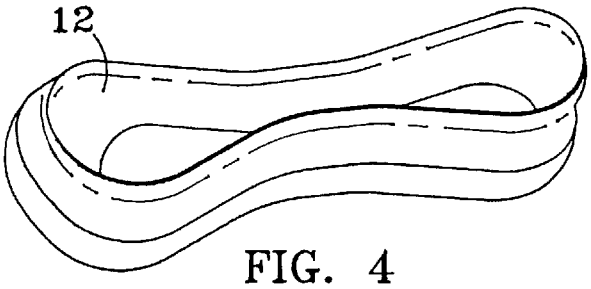
FIG. 4. is a perspective view of the continuous band embodiment of the display device.

FIG. 4 shows an embodiment of display device 12 which is formed from a continuous piece of material.

Figure 5:
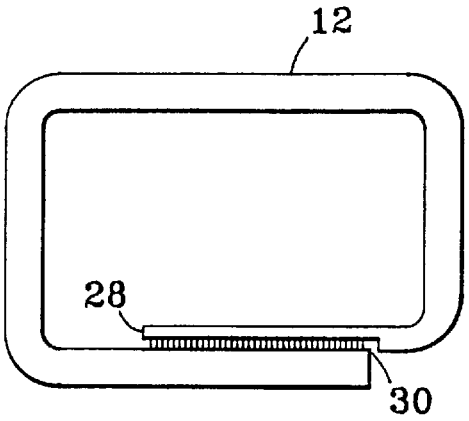
FIG. 5. is a plan view showing the non-continuous band embodiment of the display device with the two ends attached.

FIG. 5 in comparison shows an embodiment of display device 12 which is formed with two ends 28 and 30 which are adjustably and removably attachable by means of, for example VELCRO® brand hook and loop fastener.

Figure 6:
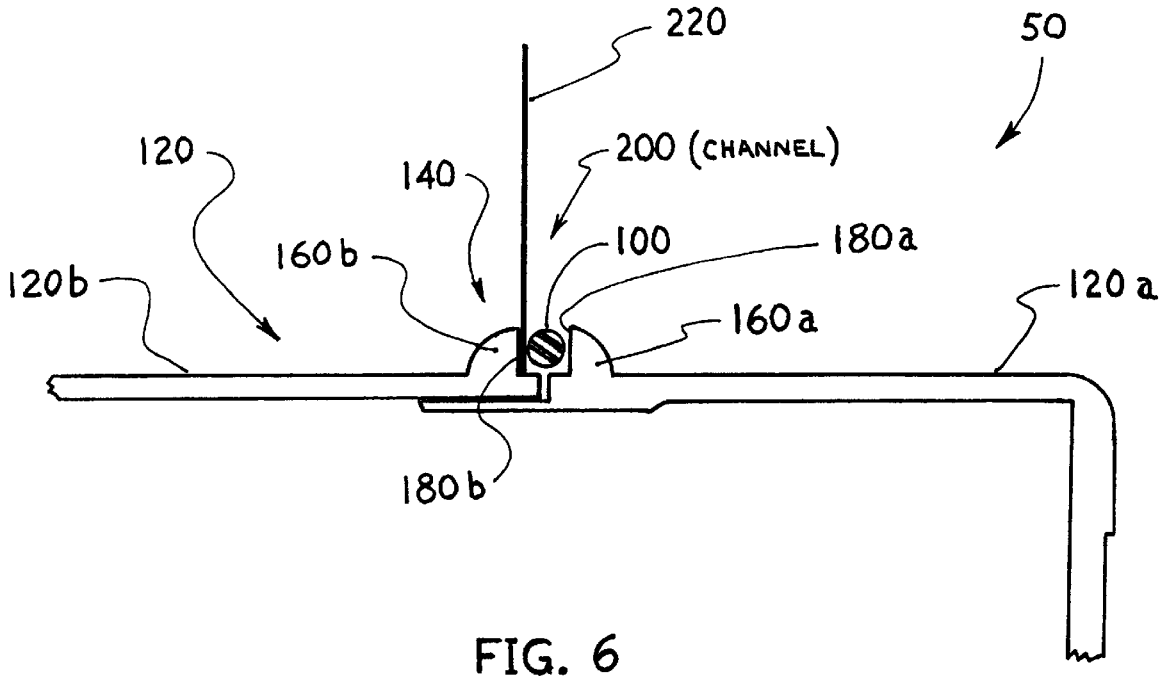
FIG. 6. is a partial cross-sectional view of the outer surface covering of an appliance, such as a computer monitor, showing the length-wise deformable band mated with a supporting portion comprising two raised extensions formed in the outer surface covering of the appliance thereby creating a "built-in" means for displaying articles.

FIG. 6 shows one specific embodiment of the invention with an article 220 displayed on an appliance 50. In this embodiment, a length-wise deformable band 100 may be installed in mating contact with a supporting portion 140 comprising a raised extension 160*a* and a cooperating raised extension 160*b* formed, molded, or disposed on the outer surface case or covering 120 of an appliance. Many appliances, such as computer monitors, are encased in a molded plastic outer surface covering or shell. The outer surface covering 120 is often formed from two pieces of molded plastic (or other similar material), a front section 120*a* and back section 120*b*, which fit or snap together to allow access to the inside of the appliance. In this particular embodiment, the supporting portion 140 comprises a raised extension 160*a* of the material forming the front section 120*a* of the outer surface case or covering 120 of the appliance 50, and further comprises preferably at least one substantially flat surface 180*a* substantially perpendicularly directed from the outer surface covering 120 of the appliance, and located perimetrically to the front-facing portion of the appliance 50. Supporting portion 140 also comprises a cooperating raised extension 160*b* of the material forming the back section 120*b* of the outer surface covering 120 of the appliance and further comprises preferably at least one substantially flat surface 180*b* substantially perpendicularly directed from the outer surface covering 120 of the appliance, and located perimetrically to the front-facing portion of the appliance 50. While FIG. 6 shows raised extension 160*a* and cooperating raised extension 160*b* respectively at the joining edges of front section 120*a* and 120*b*, it is clear that extensions 160*a* and 160*b* could both be on either the front section 12*a* or the back section 120*b*.

The substantially flat surface 180*a* of raised extension 160*a* of the outer surface covering 120 of appliance 50 opposingly faces substantially flat surface 180*b* of cooperating raised extension 160*b* of the outer surface covering 120 of appliance 50. Supporting portion 140, with substantially flat surface 180*a* and with substantially flat surface 180*b* forms a raised appliance channel 200, in which length-wise deformable band 100 is placed in mating contact with surface 180*a* and surface 180*b* to form a means for displaying articles. An article to be displayed 220, such as a photograph, note card, or memo, may be displayed by inserting article 220 between length-wise deformable band 100 and either surface 180*a* or surface 180*b*. Article 220 is held in place by the mating contact between length-wise deformable band 100 and surface 180*a* and/or surface 180*b*.

Although not shown, more than one article may be inserted for display, between length-wise deformable band 100 and surfaces 180*a* and 180*b*. For example, an article 220 may be inserted, as shown, between surface 180*b* and length-wise deformable band 100, and another article may be inserted between surface 180*a* and length-wise deformable band 100. Also not shown, an article may be displayed by inserting one end of the article between surface 180*b* and length-wise deformable band 100, and inserting another end of the article between length-wise deformable band 100 and surface 180*a* such that two ends of the article are held for display.

Also not shown, there could be a plurality of single raised extensions, either "built-in" or attached to outer surface covering 120 of appliance 50, acting alone or in cooperating pairs, and at locations other than where the front and back sections join.

Figure 6A:
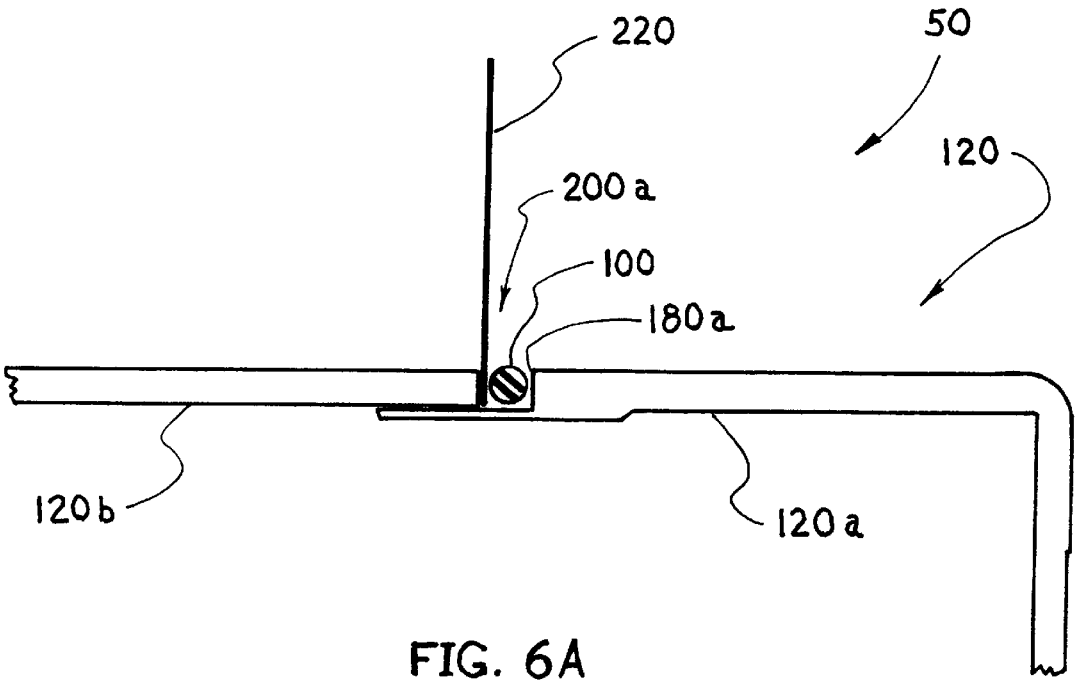
FIG. 6A shows the creation of an appliance channel wherein there are no raised extensions on the outer surface covering but wherein the front section and the back section, when assembled, create thereby the appliance channel which has at least one substantially flat surface or wall (shown here formed in the front section) substantially perpendicularly directed from the outer surface covering of the appliance, and located perimetrically to the front-facing portion of appliance.

FIG. 6A shows the creation of an appliance channel 200*a* wherein there are no raised extensions 160*a* or 160*b* on outer surface covering 120 but wherein front section 120*a* and back section 120*b*, when assembled create thereby the appliance channel 200*a* which has at least one substantially flat surface or wall 180*a* (shown here formed in front section 120*a*) substantially perpendicularly directed from outer surface covering 120 of appliance 50, and located perimetrically to the front-facing portion of appliance 50. Length-wise deformable band 100 may then be inserted in appliance channel 200*a* in mating contact with substantially flat surface 180*a*. An article to be displayed 220 is then inserted into appliance channel 200*a* between substantially flat surface 180*a* and length-wise deformable band 100.

Figure 7A:
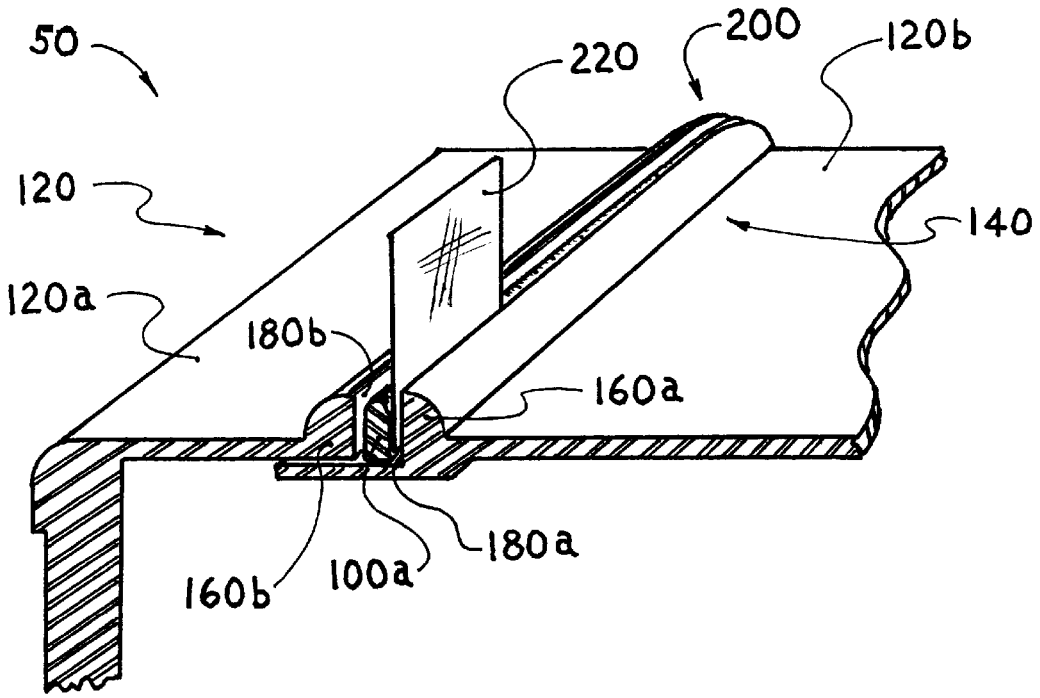
FIG. 7A. is similar to FIG. 6, but shows use of a length-wise deformable band having a non-circular cross section as opposed to the band shown in FIG. 6 which has a circular cross-section, and showing an article displayed in the thereby created means for displaying articles.
Figure 7B:
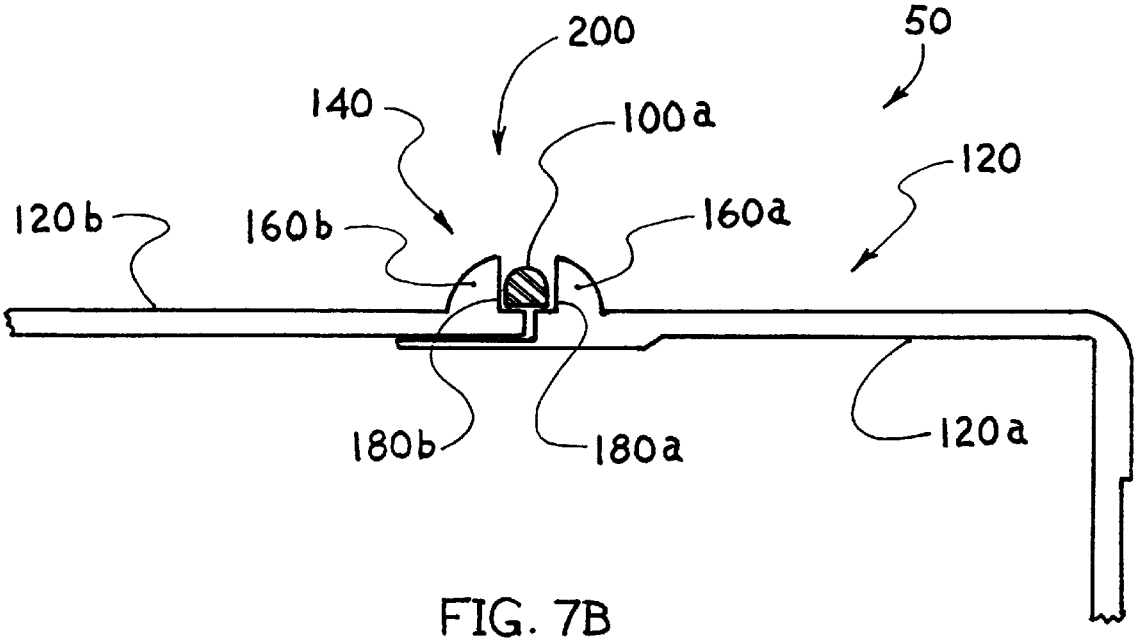
FIG. 7B. is a cross-section as shown in FIG. 7A having nothing displayed.

FIG. 7A. is similar to FIG. 6, but shows use of a length-wise deformable band 100*a* which has a non-circular cross section as opposed to the length-wise deformable band 100 shown in FIG. 6 which has a circular cross-section, and showing an article 220 displayed in the raised appliance channel 200 created by the mating contact between length-wise deformable band 100 and surface 180*b*. FIG. 7B. simply shows a cross-section of the embodiment shown in FIG. 7A having nothing inserted in raised appliance channel 200 for display.

Figure 8A:
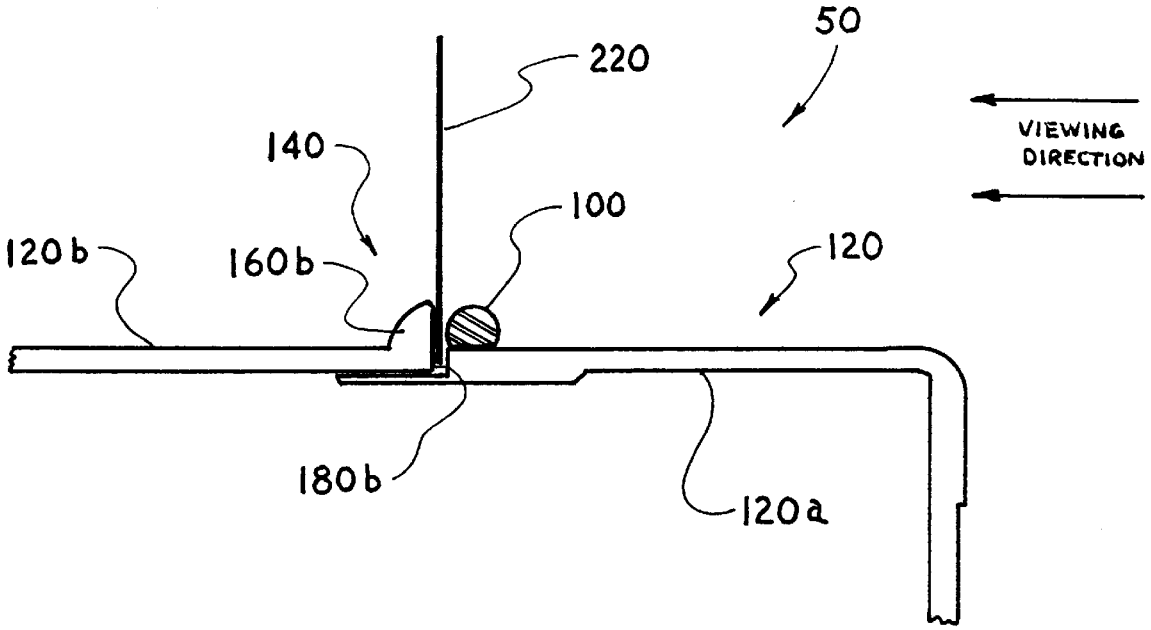
FIG. 8A. is a partial cross-sectional view showing the outer surface covering of an appliance having a supporting portion comprising one raised extension.
Figure 8B:
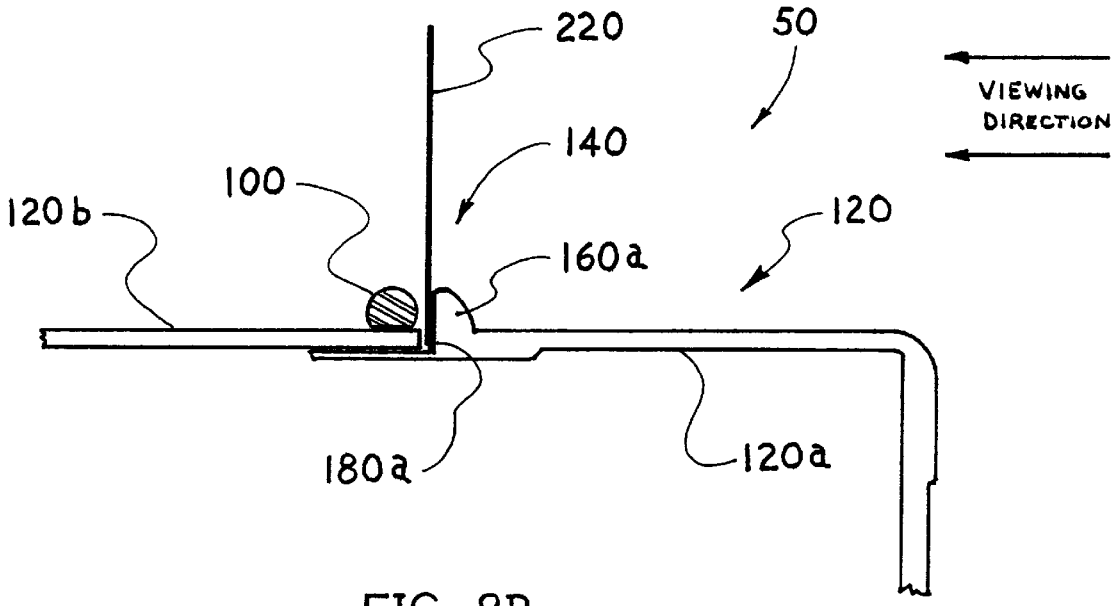
FIG. 8B. is similar to FIG. 8A, but shows the raised extension of the supporting portion formed such that it is visible from the front of the appliance, while the length-wise deformable band is not visible from the front of the appliance whether or not an article is displayed.

FIG. 8A. is a partial cross-sectional view of an embodiment of the invention showing the outer surface covering 120 of appliance 50 having a supporting portion 140 comprising only a raised extension 160*b* having surface 180*b*, in mating contact with length-wise deformable band 100 to create a means for displaying articles. In this particular embodiment, appliance 50 is shown with raised extension 160*b* disposed such that when viewing the front of appliance 50, raised extension 160*b* is not visible when article 220 is displayed, and where length-wise deformable band 100 is visible from the front of appliance 50 whether or not an article 220 is displayed. FIG. 8B. is similar to FIG. 8A, but shows a supporting portion 140 comprising only raised extension 160*a* and which is visible from the front of appliance 50 when an article 220 is displayed, while length-wise deformable band 100 is not visible from the front of appliance 50 whether or not an article 220 is displayed.

Figure 9:
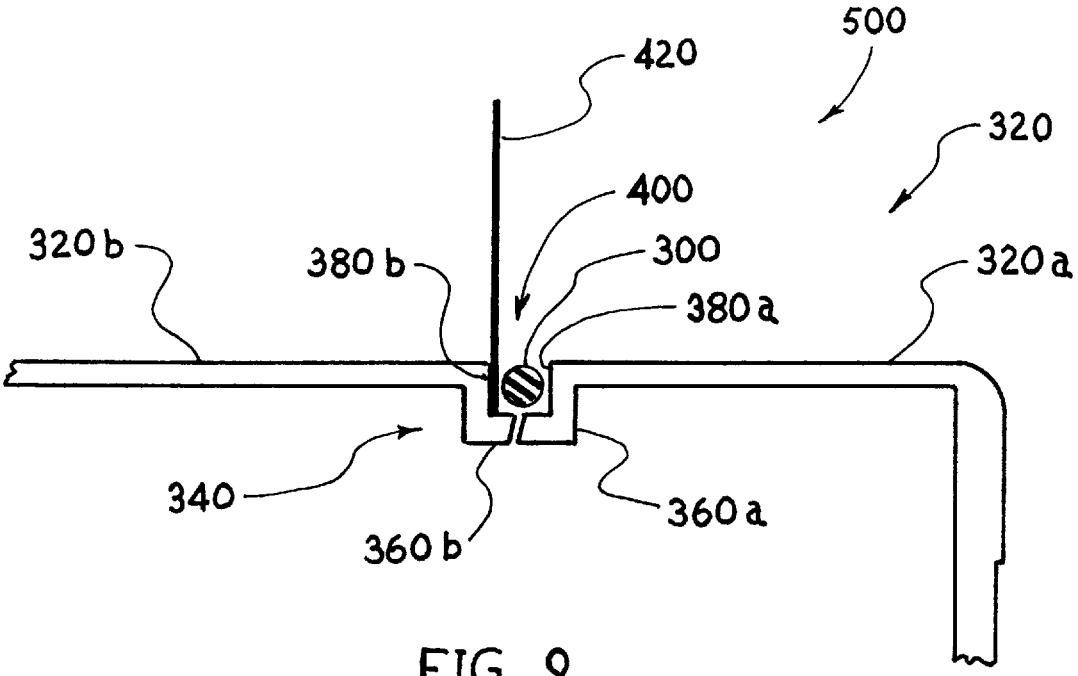
FIG. 9 shows a partial cross-sectional view of the outer surface covering of an appliance in which the supporting portion is recessed.

FIG. 9 shows a partial cross-sectional view of the outer surface covering 320 of an appliance 500 in which the supporting portion 340 is recessed into the outer surface covering 320. In such an embodiment, there is formed a recessed channel 360*a* having a substantially flat surface 380*a*, and there is formed a cooperating recessed channel 360*b* having a substantially flat surface 380*b*, at a location where two sections of outer surface covering 320 of appliance 500 may be joined. Length-wise deformable band 300 is inserted into the recessed appliance channel 400 created between surface 380*a* and surface 380*b*. An article 420, or articles, to be displayed may then be inserted between length-wise deformable band 300 and either or both of surface 380*a* and/or surface 380*b*. Length-wise deformable band 300 may be circular or non-circular in cross-section. A supporting portion may also be formed by making recessed channels in the outer surface covering of an appliance at locations other than where the front and back sections join. One or also multiple recessed channels may be made, thereby forming a plurality of recessed appliance channels for insertion of articles to be displayed.

Figure 10:
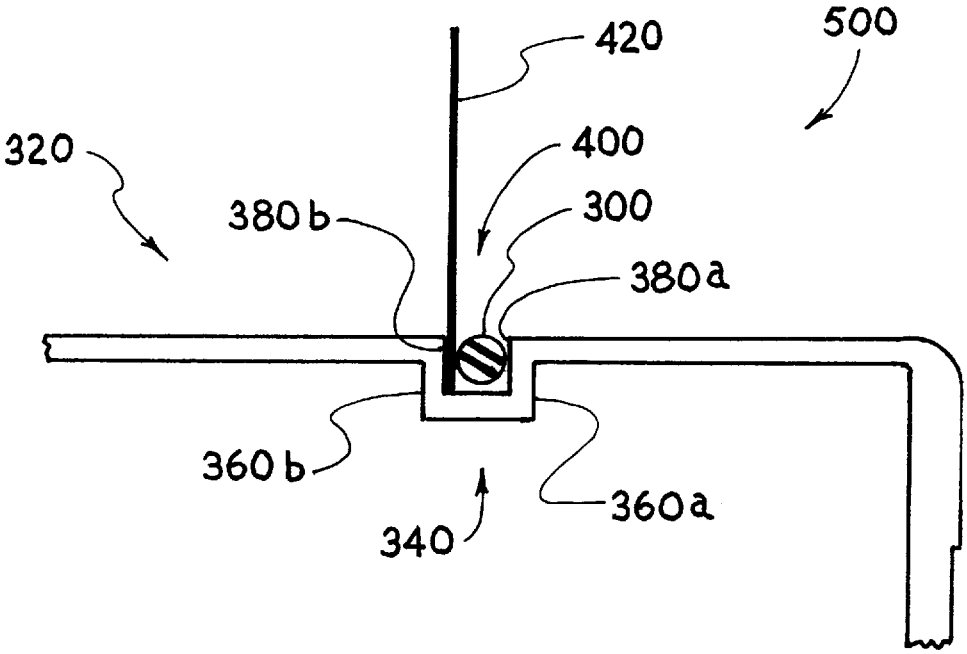
FIG. 10 shows a partial cross-sectional view of the outer surface covering of an appliance in which the supporting portion is recessed into the outer surface covering, but which is not formed where two sections of outer surface covering are joined.

FIG. 10 shows a partial cross-sectional view of the outer surface covering 320 of an appliance 500 in which the supporting portion 340 is recessed into the outer surface covering 320, but which is not formed where two sections of outer surface covering 320 are joined. In such an embodiment, there is formed a recessed channel 360*a* having a substantially flat surface 380*a*, and there is formed a cooperating recessed channel 360*b* having a substantially flat surface 380*b*. Recessed channel 360*a* and cooperating recessed channel 360*b* thereby form a recessed appliance channel 400. Length-wise deformable band 300 is inserted into the recessed appliance channel 400 created between surface 380*a* and surface 380*b*, in mating contact with surface 380*a* and surface 380*b*. An article 420, or articles, to be displayed may then be inserted between length-wise deformable band 300 and either or both of surfaces 380*a* and/or surface 380*b*. Length-wise deformable band 300 may be circular or non-circular in cross-section.

Although not shown, it is possible that the support portion, comprising a raised extension and a substantially flat surface could also be manufactured separately, and added to an appliance after manufacture and assembly. The supporting portion could be formed of single or multiple raised extensions, alone or in cooperating pairs. The raised extensions could be attached by various attachment means such as with adhesive, or by screwing, bolting, snapping or otherwise fastening the raised extensions to the outer surface covering of the appliance. A user could then attach as few or as many raised extensions, singly or in cooperating pairs, and in whatever location on the appliance as is desired. The device for displaying articles could thus be removed or transferred to a different location on an appliance or to a different appliance.

Figure 11:
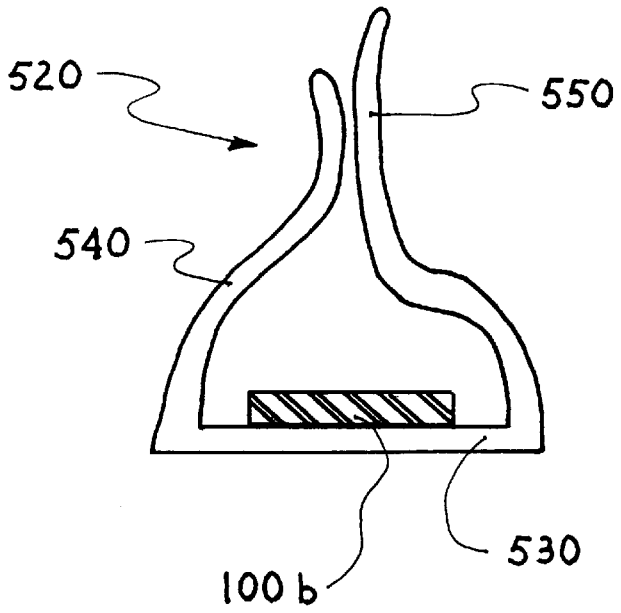
FIG. 11 is a cross sectional view showing a clip attached to a substantially flat length-wise deformable band.
Figure 12:
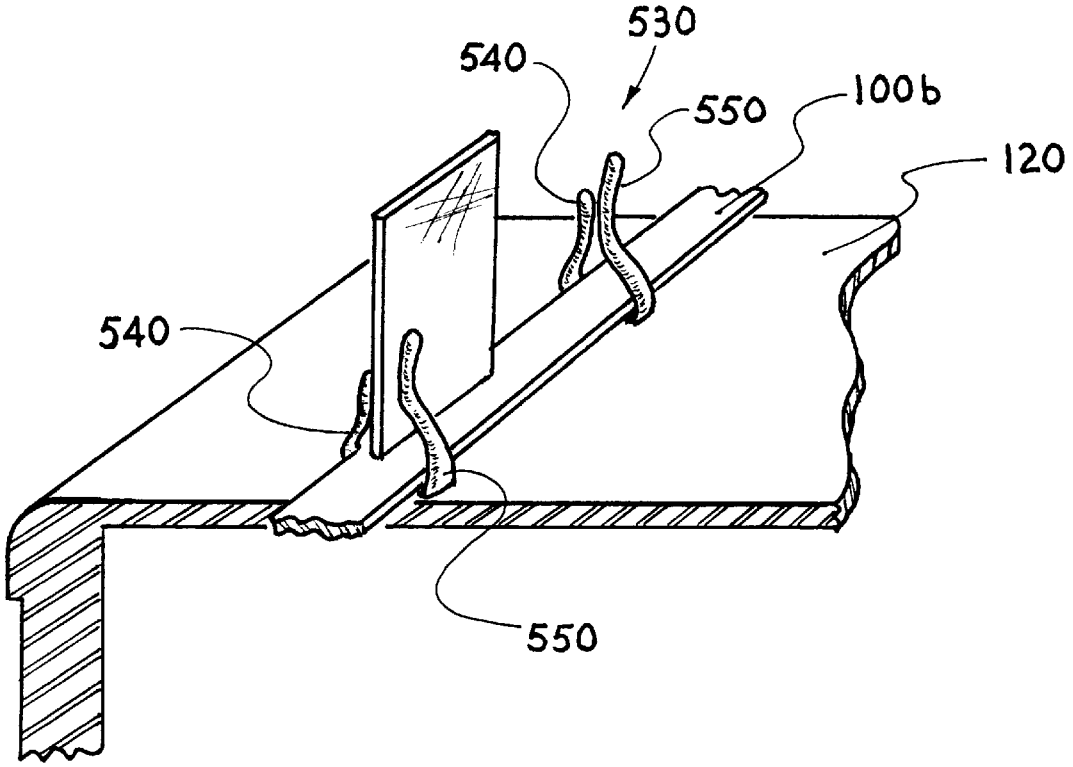
FIG. 12 is a perspective illustration of the outer surface covering of an appliance showing a displayed article inserted into and held by a clip attached to a substantially flat length-wise deformable band which is securing the clip in place on the appliance, and a second clip with nothing inserted.

FIGS. 11 and 12 illustrate yet another embodiment of the display device wherein there may be provided a method for attaching at least one object 220 to an appliance comprising installing a flexible, length-wise deformable band 100*b* around the perimeter of an appliance, attaching at least one clip 520 to band 100*b*, and inserting an edge of at least one object 220 into clip 520 and sliding the object 220 into clip 520 whereby object 220 is secured in clip 520. Also illustrated therefore is a display device for attaching articles to appliances and displaying articles on the appliance wherein an outer surface covering 120 of the appliance defines the perimeter of the appliance and flexible, length-wise deformable band 100*b* is installed around the perimeter of the appliance in mating frictionous contact with outer surface covering 120 and a clip 520 is secured in mating contact between outer surface covering 120 and length-wise deformable band 100*b*. Clip 520 may be a standard spring type clip having a lower substantially flat portion 530 and a relatively short gripping prong 540 and a somewhat longer guiding prong 550 each extending upwards from lower substantially flat portion 530, wherein gripping prong 540 and guiding prong 550 substantially oppose each other in close proximity and are forced apart under tension when an object 220 is inserted in mating frictionous contact between gripping prong 540 and guiding prong 550. Object 220 is secured in clip 520 in mating frictionous contact with gripping prong 540 and guiding prong 550 by the tension between the now forced apart gripping prong 540 and guiding prong 550. There may be only one, or a plurality, of clips 520 attached to band 100*b* to hold various numbers of objects 220. The numbers and location of clips 520 may be easily varied because the clips 520 are not fixedly attached to either band 100*b* or appliance 50, (and neither is band 100*b* fixedly attached to appliance 50) but are held in place by frictionous contact due to the flexibility and elasticity of band 100*b*. The fact that no embodiment of this invention requires that the band, or any other component be fixedly attached to the appliance allows for easy, non-damaging installation and removal the the display device. Also the size and shape of the clip may vary and the width of the clip may be as much as the length of a side of an appliance. Although band 100*b* is illustrated in FIGS. 11 and 12 as being substantially flat, it is understood that clip 520 (or multiple clips) may be attached to an appliance using any of the various shaped bands 100, 100*a* or the channeled band of display device 12.

Additionally, display device 12 and length-wise deformable band 100, 100*a*, 100*b* and 300, and clip 520 may be manufactured in various colors and shapes to coordinate with the surroundings and appliances on which they are used. The length-wise deformable band of the present invention is of such a size and elasticity that a band of one size may be installed on a variety of appliances of different size yet still function Display device 12 may also be manufactured to display a name or logo on a surface of display device 12 facing the viewer or the user of an appliance.

It is thought that the present invention, the method and the display device for attaching objects or articles to appliances, and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

ELEMENTS

50—the appliance
100—length-wise deformable band
120—outer surface covering
120*a*—front section of 120
120*b*—back section of 120
140—supporting portion
(160—raised extensions)
160*a*—raised extension
160*b*—cooperating raised extension
(180—substantially flat surfaces)
180*a*—substantially flat surface/wall
180*b*—substantially flat surface/wall
200—raised appliance channel
200*a*—appliance channel
220—article to be displayed
500—appliance
300—length-wise deformable band
320—outer surface covering
320*a*—front section of 320
320*b*—back section of 320
340—support portion
(360—recessed channels)
360*a*—recessed channel
360*b*—cooperating recessed channel
(380—substantially flat surfaces)
380*a*—substantially flat surface/wall
380*b*—substantially flat surface/wall
400—recessed appliance channel
420—article to be displayed
500—appliance
520—clip
530—substantially flat portion of clip
540—gripping prong (short one)
550—guiding prong (long one)

I claim:

1. A display device for attaching articles to an appliance and displaying said articles on said appliance comprising:

an outer surface covering of said appliance;

at least one supporting portion disposed on said outer surface covering of said appliance; and a flexible, length-wise deformable band installed in mating contact with said at least one supporting portion such that an article to be displayed is inserted in mating contact between said length-wise deformable band and said supporting portion.

2. The display device according to claim 1 wherein said outer surface covering of said appliance further comprises a front section and a back section.

3. The display device according to claim 2 wherein said front section and said back section when assembled create thereby an appliance channel having at least one substantially flat wall substantially perpendicularly directed from said outer surface covering of said appliance located perimetrically to the front-facing portion of said appliance.

4. The display device according to claim 3 wherein said at least one supporting portion disposed on said outer surface covering of said appliance is said appliance channel; and said flexible, length-wise deformable band is installed within said appliance channel such that an article to be displayed is inserted in mating contact between said length-wise deformable band and one of said at least one substantially flat wall of said appliance channel.

5. The display device according to claim 1 wherein said length-wise deformable band is a one-piece, continuous band.

6. The display device according to claim 4 wherein said length-wise deformable band is a one-piece, continuous band.

7. The display device according to claim 1 wherein said length-wise deformable band is a one-piece band further comprising two ends attachable each to the other.

8. The display device according to claim 4 wherein said length-wise deformable band is a one-piece band further comprising two ends attachable each to the other.

9. The display device according to claim 1 wherein each said at least one supporting portion further comprises a raised extension having at least one substantially flat surface substantially perpendicularly directed from said outer surface covering of said appliance wherein said at least one substantially flat surface is in mating contact with said length-wise deformable band.

10. The display device according to claim 2 wherein each said at least one supporting portion further comprises a raised extension having at least one substantially flat surface substantially perpendicularly directed from said outer surface covering of said appliance wherein said at least one substantially flat surface is in mating contact with said length-wise deformable band.

11. The display device according to claim 10 wherein said at least one supporting portion is disposed on said front section of said outer surface covering of said appliance.

12. The display device according to claim 10 wherein said least one supporting portion is disposed on said back section of said outer surface covering of said appliance.

13. The display device according to claim 9 wherein said at least one supporting portion further comprises a cooperating raised extension having at least one substantially flat surface substantially perpendicularly directed from said outer surface covering and wherein said cooperating raised extension flat surface and said raised extension flat surface oppose each other creating a raised extension appliance channel therebetween into which said length-wise deformable band is installed.

14. The display device according to claim 10 wherein said at least one supporting portion further comprises a cooperating raised extension having at least one substantially flat surface substantially perpendicularly directed from said outer surface covering and wherein said cooperating raised extension flat surface and said raised extension flat surface oppose each other thereby creating a raised extension appliance channel therebetween into which said length-wise deformable band is installed.

15. The display device according to claim 14 wherein said raised extension is disposed on said front section of said outer surface covering of said appliance, and wherein said cooperating raised extension is disposed on said back section of said outer surface covering of said appliance thereby forming said raised extension appliance channel at a location where said front section and said back section of said outer surface covering of said appliance are joined.

16. The display device according to claim 1 wherein said at least one supporting portion comprises a recessed channel disposed on said outer surface covering, said recessed channel having at least one substantially flat surface substantially perpendicularly directed from said outer surface covering creating thereby a recessed appliance channel into which said length-wise deformable band is installed.

17. The display device according to claim 2 wherein said at least one supporting portion comprises a recessed channel disposed on said outer surface covering, said recessed channel having at least one substantially flat surface substantially perpendicularly directed from said outer surface covering creating thereby a recessed appliance channel into which said length-wise deformable band is installed.

18. The display device according to claim 10 wherein said at least one supporting portion further comprises a cooperating recessed channel having at least one substantially flat surface substantially perpendicularly directed from said outer surface covering and wherein said cooperating recessed channel flat surface and said recessed channel flat surface oppose each other creating a recessed appliance channel therebetween into which said length-wise deformable band is installed.

19. The display device according to claim 17 wherein said at least one supporting portion further comprises a cooperating recessed channel having at least one substantially flat surface substantially perpendicularly directed from said outer surface covering and wherein said cooperating recessed channel flat surface and said recessed channel flat surface oppose each other creating said recessed appliance channel therebetween into which said length-wise deformable band is installed.

20. The display device according to claim 17 wherein said recessed channel is disposed on said front section of said outer surface covering of said appliance.

21. The display device according to claim 17 wherein said recessed channel is disposed on said back section of said outer surface covering of said appliance.

22. The display device according to claim 1 wherein said length-wise deformable band has a circular cross-section.

23. The display device according to claim 1 wherein said length-wise deformable band has a non-circular cross-section.

24. A method for displaying articles on an appliance having an outer surface covering thereof comprising the steps of:

forming at least one supporting portion in said outer surface covering;

installing in mating contact with said at least one supporting portion, a flexible length-wise deformable band; and inserting articles in mating contact between said at least one supporting portion and said length-wise deformable band, thereby displaying said articles.

25. The method according to claim 24 further comprising the steps of:

disposing on said outer surface covering at least one raised extension having at least one substantially flat surface, said at least one raised extension being said at least one supporting portion; and installing said flexible length-wise deformable band in mating contact with said at least one substantially flat surface.

26. The method according to claim 25 further comprising the steps of:

further disposing on said outer surface covering a cooperating raised extension cooperating with one of said at least one raised extensions, each said cooperating raised extension having at least one substantially flat surface wherein said cooperating raised extension flat surface and said raised extension flat surface oppose each other thereby creating a raised extension appliance channel therebetween into which said length-wise deformable band is installed.

27. The method for displaying articles according to claim 24 further comprising;

disposing on said outer surface covering at least one recessed channel having at least one substantially flat surface, said at least one recessed channel being said at least one supporting portion; and installing said flexible length-wise deformable band in mating contact with said at least one substantially flat surface.

28. The method for displaying articles according to claim 24 wherein said at least one recessed channel is formed by the joining edges of a front section and a back section of said outer surface covering of said appliance, thereby creating a recessed appliance channel into which said length-wise deformable band is installed.

* * * * *